US005507131A

United States Patent [19]

Schluger

[11] Patent Number: 5,507,131

[45] Date of Patent: Apr. 16, 1996

[54] MAIL SOLICITATION PACKAGE ASSEMBLY

[76] Inventor: Allen Schluger, 21 W. 68th St., New York, N.Y. 10023

[21] Appl. No.: 349,541

[22] Filed: Dec. 5, 1994

[51] Int. Cl.[6] ..... B65B 11/48; B65D 27/00

[52] U.S. Cl. ..... 53/460; 53/411; 53/569; 493/216

[58] Field of Search ..... 53/460, 411, 429, 53/206, 131.4, 131.2, 284.3, 569; 229/92.8, 92.3; 493/216

[56] References Cited

U.S. PATENT DOCUMENTS 3,618,284 11/1971 Gendron ..... 53/460 X
3,656,684 4/1972 Meehan ..... 229/92.8
4,071,997 2/1978 Gunther, Jr. et al. ..... 53/206
4,189,895 2/1980 Volkert et al. ..... 53/460 X
4,531,993 7/1985 Bradley ..... 53/460 X
4,828,104 5/1989 Ribellino, Jr. ..... 53/460 X
4,925,086 5/1990 Stahlman ..... 229/92.3

*Primary Examiner*—James F. Coan

[57] ABSTRACT

A mailed business-solicitation letter personalized with an intended recipient's address at one selected location and his/her name at a second selected location, which is embodied in a cardboard mailing enclosure to provide an external display of the mailing address to assist in the delivery thereof and to present the name as a personalized salutation of the letter, to thereby contribute to obviating the stigma of unsolicited "junk" mail.

1 Claim, 1 Drawing Sheet

MAIL SOLICITATION PACKAGE ASSEMBLY

The present invention relates generally to the use of "personalized" mail to solicit product sales, and more particularly to a preparation of the mailing piece used in the mail order solicitation which significantly enhances the "personalized" aspect thereof in the presentation made to the prospective customer,

EXAMPLE OF THE PRIOR ART

To avoid summary treatment as unsolicited "junk" mail, it is already acknowledged that mail solicitation that identifies the recipient by name, i.e. by a given name and by a surname, is highly desirable, and is the approach exemplified by U.S. Pat. No. 4,925,086 for "Response Letter" issued to Harold E. Stahlman on May 15, 1990. In this patent, a "personalized" mailing address printed on a letter is displayed in a display window of the mailing enclosure used in mailing the letter, and by reason of this external display assists the postal delivery and also significantly avoids the stigma of "junk" mail, but not entirely. The Stahlman displayed mailing address presents an appearance that too closely resembles a paste-on label, which is another tell-tale attribute of unsolicited mail. Thus, the Stahlman mailer might motivate opening the package, but even a cursory review of the contents by virtue of lacking any additional "personalization" is often summarily discarded after such review.

Broadly, it is an object of the present invention to assemble a mail order solicitation overcoming the foregoing and other shortcomings of the prior art.

More particularly, it is an object in the use of a mail solicitation letter embodied with "personalized" attributes to make a presentation of these attributes which motivates the recipient to not only open the package, but also to give serious consideration to the sales message therein, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

As understood, sales solicited by mail which refers by name, rather than generally to "resident", is more favorably treated by the addressee-recipient and more apt to result in a successfully solicited sale. Stated otherwise, a mailing piece addressed to "resident" is often considered unsolicited "junk" mail and disposed of with little or no consideration.

Figure 6:
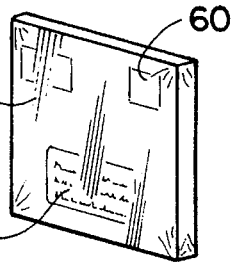
FIG. 6 illustrates, in perspective, the mail-solicitation package hereof in condition for mailing.

Of significant utility therefore is the mail solicitation package, generally designated 10 in FIG. 6, having a transparent plastic shrink wrap 12 which promotes proper handling during mailing, and through which it will be understood the recipient will see an address, at 14, which identifies the recipient by full name, i.e. his/her given name and surname.

The printing of the personalized mailing address is achieved in a well understood printing operation by any one of several commercially available printing apparatuses such as the printing apparatus sold under the trademark ADMARK by Kodak, Inc. of Rochester, N.Y. in the operation of which, from a computer data base of a large number of names and associated addresses, each name-address combination is printed successively on successively fed paper substrates. Thus, on a paper substrate in strip form along a first length portion the imprint at the printing station might be "Mister A" with address, along a second or succeeding length portion "Mister B" with address, along a third or next succeeding length portion "Mister C" with address, and so on. It is contemplated that the imprinted strip substrate will have been previously imprinted with product and/or promotional data, so that after die cutting of the strip all resulting substrates are, as to the product and promotional data, identical, but are significantly differentiated from each other by virtue of the personalizing resulting from the subsequently added different names and associated street addresses.

Figure 2:
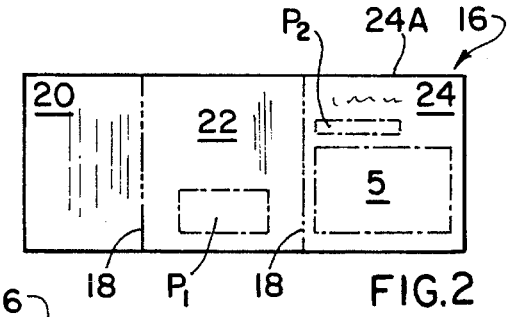
FIG. 2 is of the transmitted letter component showing in front elevation one surface thereof.
Figure 3:
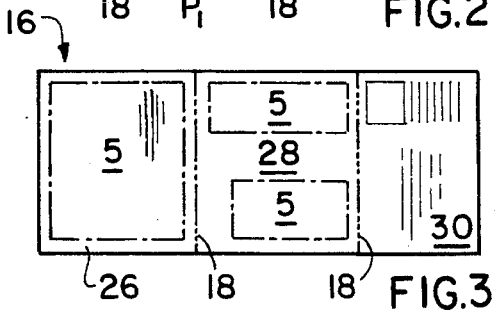
FIG. 3 is a view similar to FIG. 2 of the transmitted letter component, but of the opposite surface thereof.

The present invention relates to a mail-solicitation component as above personalized, which is embodied in the package 10 of FIG. 6 so that the package address 14 related to the intended recipient is visible and effectively used in the mail delivery of the package. Reference should be made first to FIGS. 2 and 3 which respectively illustrate first and second surfaces of a letter insert 16. Letter 16 is delineated by lines of perforations 18 into three panels designated on the FIG. 2 surface as 20, 22 and 24 and on the FIG. 3 surface as 26, 28 and 30. In one printing run at uniformly spaced intervals along the strip substrate there is imprinted product or promotional content for the soliciting letter 16 at locations individually designated S on the FIG. 3 surface, and in a second printing run at location S on the FIG. 2 surface. Alternatively, and as is well understood, both sides of the paper strip in the same printing run can be printed with the product data or text at the locations S. However, in a special additional printing run in connection with the first surface or FIG. 2 side of letter 16, at the selected location P1 a personalized name-address combination, and at selected location P2 a salutation using the name of the addressee, are simultaneously imprinted on letter 16.

Figure 1:
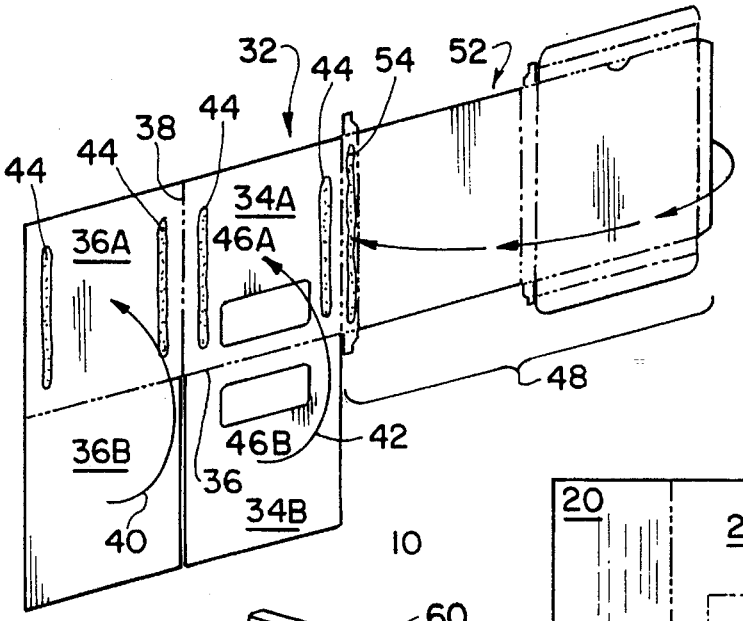
FIG. 1 is a perspective view of a mail-solicitation letter-transmitting component for use in accordance with the within inventive method.
Figure 5:
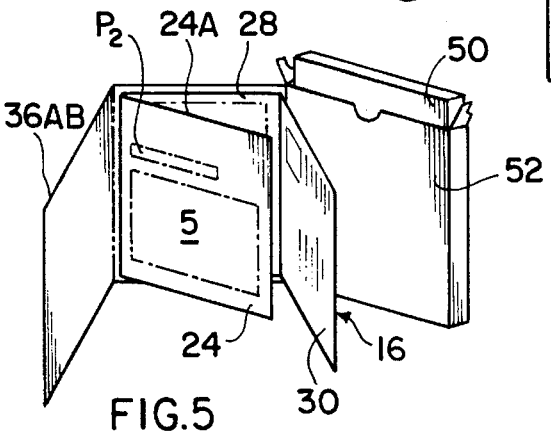
FIG. 5 is another perspective view of the illustrated subject matter of FIG. 4, but in a final condition of assembly.
Figure 4:
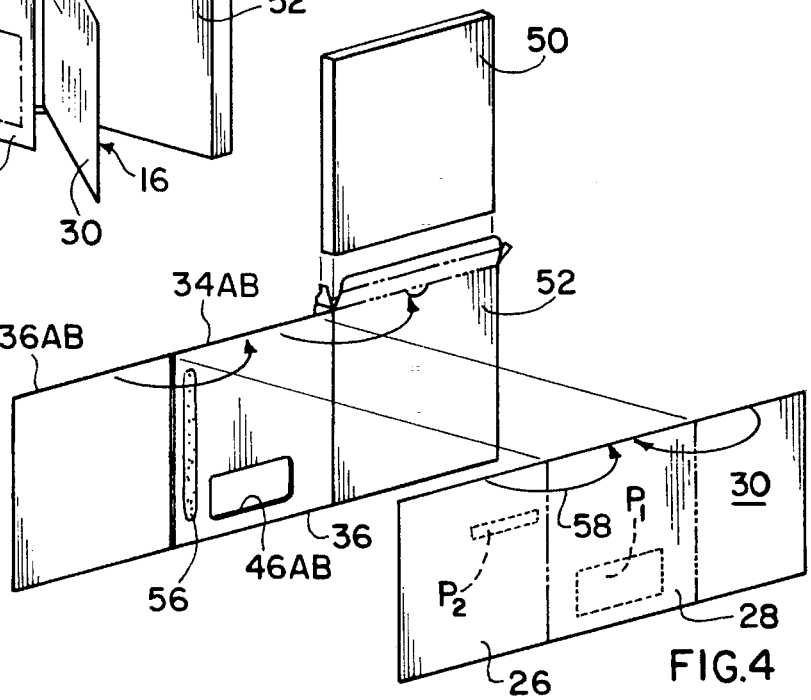
FIG. 4 is a perspective view of the component of FIG. 1 and the component of FIGS. 2, 3 in an intermediate condition of assembly.

The component for transmitting each letter 16 and which completes the package 10 is best understood from FIGS. 1, 4 and 5, to which reference should now be made. From cardboard stock there is die cut a blank, generally designated 32, providing cooperating underlying rear panel 34A and extending from a bottom edge 36 an overlying front panel 34B and extending from a side edge 38 an underlying rear panel 36A and a cooperating overlying panel 36B, folded as noted by directional arrows 40 and 42 into two-ply constructions and adhered together by adhesive deposits 44. In the die cutting of rear panel 36A and front panel 36B there is provided aligning data or address-displaying openings or windows 46A, 46B. In the described example, but considered optional, package 10 can include a box 48 sized to transmit appropriate contents 50, such as a book, video cassette or like objects, that is embodied in the package 10 using a flap 52 and adhesive attachment at 54.

As best shown in FIG. 4, letter 16 with the imprinted salutation at P2 and address at P1 in a facing relation to the double ply panel 34A, 34B is adhered by the adhesive deposit 56 to this panel. As a result, the address at P1 aligns with and is displayed through the windows 46A, 46B, it being understood that during the imprinting of the address that the location P1 is selected to be adjacent the lower edge 36 of panel 34A to achieve an external display of the address P1 in the package 10.

To the same end, the salutation at location P2 is, when the panel 26 of letter 16 is turned in direction 58, presented to a reader in the traditional location of a letter, namely at a location below the upper edge 24A of panel 24 and proceeding what would be perceived as the text of the letter at location S on panel 24. It thus is also to be understood that during the imprinting of the salutation that the location P2 thereof is selected to be below the upper edge 24A of panel 24 and preceding the text imprinted at location S on panel 24.

The die cutting of the imprinted paper strip at the intervals of the repeat of the printing results in the individual letters as exemplified by the letter 16 of FIG. 5, which letter is prepared for mailing by folding the panel 24 and 20 upon the panel 28 adhesively secured to blank 32, and is next followed first by the folding of the double ply closure panel 36A, 36B and second by the merchandise-filled box 52, allowing without obstruction the address 14 to remain in external display from the package 10. Completing the preparation of package 10 for mailing is the clear plastic shrink wrap 12 applied about the folded construction of package 10 a well understood manner, For completeness sake, it is noted that to better serve its mail solicitation intended function, that on the external surface of panel 36A, 36B is imprinted postage in accordance with postal regulations at location 60, and that the text S on letter panel 20 is advantageously a business reply postcard detachable along the perforation line 18.

While the components for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of preparing a letter for mail solicitation related to the name and mailing address of the intended recipient, said letter being of a type rectangularly shaped having an area imprinted with product data and folded transversely of said imprinted area into an underlying first panel and an overlying second panel, said preparation of said letter for recipient-related mail solicitation comprising the steps of imprinting at spaced intervals in at least one printing run on a paper substrate in strip form on a first surface thereof product-related data, imprinting at said same spaced intervals in another printing run on said paper strip on an opposite second surface thereof recipient-related data in at least two selected locations, of which a first selected location is adjacent one edge and a second selected location is laterally spaced therefrom adjacent an opposite edge, delineating from said two-sided imprinted paper strip at each said spaced interval a letter for mailing to a recipient related to the imprinted data at said two selected locations, die-cutting from a cardboard substrate a blank serving as a mailing enclosure for said letter formed of an underlying back panel having a lower edge and a side edge and extending from said lower edge an overlying front panel and from said side edge a closure panel, said underlying back and overlying front panels having die-cut data-displaying openings at selected locations adapted to align with each other in an overlying position of said front panel upon said underlying back panel, adhesively securing said front panel to said rear panel to form a double ply construction with said die-cut data-displaying openings in aligned relation, and adhesively securing said letter for mailing with said imprinted second surface to said double ply construction formed by said back and front panels with said one imprinted recipient-related data in alignment with said data-displaying openings, whereby the data through said openings provides an external display of mailing address information of the intended recipient and the recipient-related data at said second location is presented to a reader as a personalized salutation of a letter.

* * * * *